US005168985A

United States Patent [19]

Shih

[11] Patent Number: 5,168,985

[45] Date of Patent: Dec. 8, 1992

[54] JEWEL BOX

[76] Inventor: Yen-Tieh Shih, No. 210, Fuyi Rd., Taiping Hsiang, Taichung Hsien, Taiwan

[21] Appl. No.: 668,060

[22] Filed: Mar. 12, 1991

[51] Int. Cl.[5] ..... B65D 6/00; A45C 11/00

[52] U.S. Cl. ..... 206/45.34; 206/6.1; 206/566; 312/305; 312/135

[58] Field of Search ..... 206/6.1, 581, 566, 348, 206/823, 45.34, 45.33; 312/305, 125, 135

[56] References Cited

U.S. PATENT DOCUMENTS

| | | | |
|---|---|---|---|
| 92,619 | 7/1869 | Leonard | 312/305 X |
| 228,812 | 6/1880 | Greenbaum | 312/305 X |
| 261,417 | 7/1882 | Atkinson | 312/305 |
| 364,904 | 6/1887 | Cooper | 312/305 |
| 614,479 | 11/1898 | Klein | 312/305 |
| 631,083 | 8/1899 | Levinson | 312/135 |
| 899,466 | 9/1908 | O'Leary | 312/305 |
| 1,520,310 | 12/1924 | Rogers, Jr. | 206/566 |
| 2,950,003 | 8/1960 | Simmons et al. | 206/566 X |
| 3,997,050 | 12/1976 | Patterson | 206/566 |
| 4,058,356 | 11/1977 | Michal | 312/305 |
| 4,258,962 | 3/1981 | Slaugh | 312/125 |
| 4,261,461 | 4/1981 | Kizlauskas | 206/566 X |
| 4,286,832 | 9/1981 | Spevak | 312/305 X |
| 4,463,856 | 8/1984 | Strasser | 312/125 X |
| 4,632,474 | 12/1986 | Ingersoll | 312/305 |
| 4,688,686 | 8/1987 | Mitts et al. | 312/305 X |
| 4,768,530 | 9/1988 | Vaughn | 206/581 X |
| 4,771,206 | 9/1988 | Taylor | 312/305 X |
| 4,936,466 | 6/1990 | Nava | 206/566 X |
| 4,978,001 | 12/1990 | Nelson | 206/6.1 X |
| 5,035,319 | 7/1991 | Kunisch | 206/566 X |

*Primary Examiner*—Paul T. Sewell
*Assistant Examiner*—Ted Kavanaugh
*Attorney, Agent, or Firm*—Bacon & Thomas

[57] ABSTRACT

A jewel box includes a housing which has a base provided on a bottom and which has an opening formed in an upper portion. A telescopic tube has a lower end fixed on the base of the housing. A hanger and a cover are fixed on an upper end of the telescopic tube. The cover is provided for enclosing the opening. A number of hooks are distributed around the hanger. A loop member is fixed on top of the telescopic tube so that the hanger and the cover can be pulled upward and so that jewels hung on the hooks of the hanger can be easily reached.

4 Claims, 4 Drawing Sheets

JEWEL BOX

BACKGROUND OF THE INVENTION

1. Field of the Invention

The present invention relates to a box, and more particularly to a jewel box.

2. Description of the Prior Art

A jewel box which is available at present is generally rectangular parallelepiped and has a glass provided on each side so that the jewels can be directly seen from outside of the jewel box. The jewels are generally directly disposed on the bottom of the box so that few jewels can be exhibited in the jewel box. In some jewel boxes, the jewels may be hung within the jewel box. However, it is difficult to remove the jewels which are hung in the jewel box.

The present invention has arisen to mitigate and/or obviate the afore-described disadvantages of the jewel boxes.

SUMMARY OF THE INVENTION

The primary objective of the present invention is to provide a jewel box which has an openable cover so that the jewels disposed within the jewel box can be easily reached.

In accordance with one aspect of the invention, there is provided a jewel box which includes a housing which has a base provided on a bottom and which has an opening formed in an upper portion. A telescopic tube has a lower end fixed on the base of the housing. A hanger and a cover are fixed on an upper end of the telescopic tube. The cover is provided for enclosing the opening. A number of hooks are distributed around the hanger. A loop member is fixed on top of the telescopic tube so that the hanger and the cover can be pulled upward and so that jewels hung on the hooks of the hanger can be easily reached.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
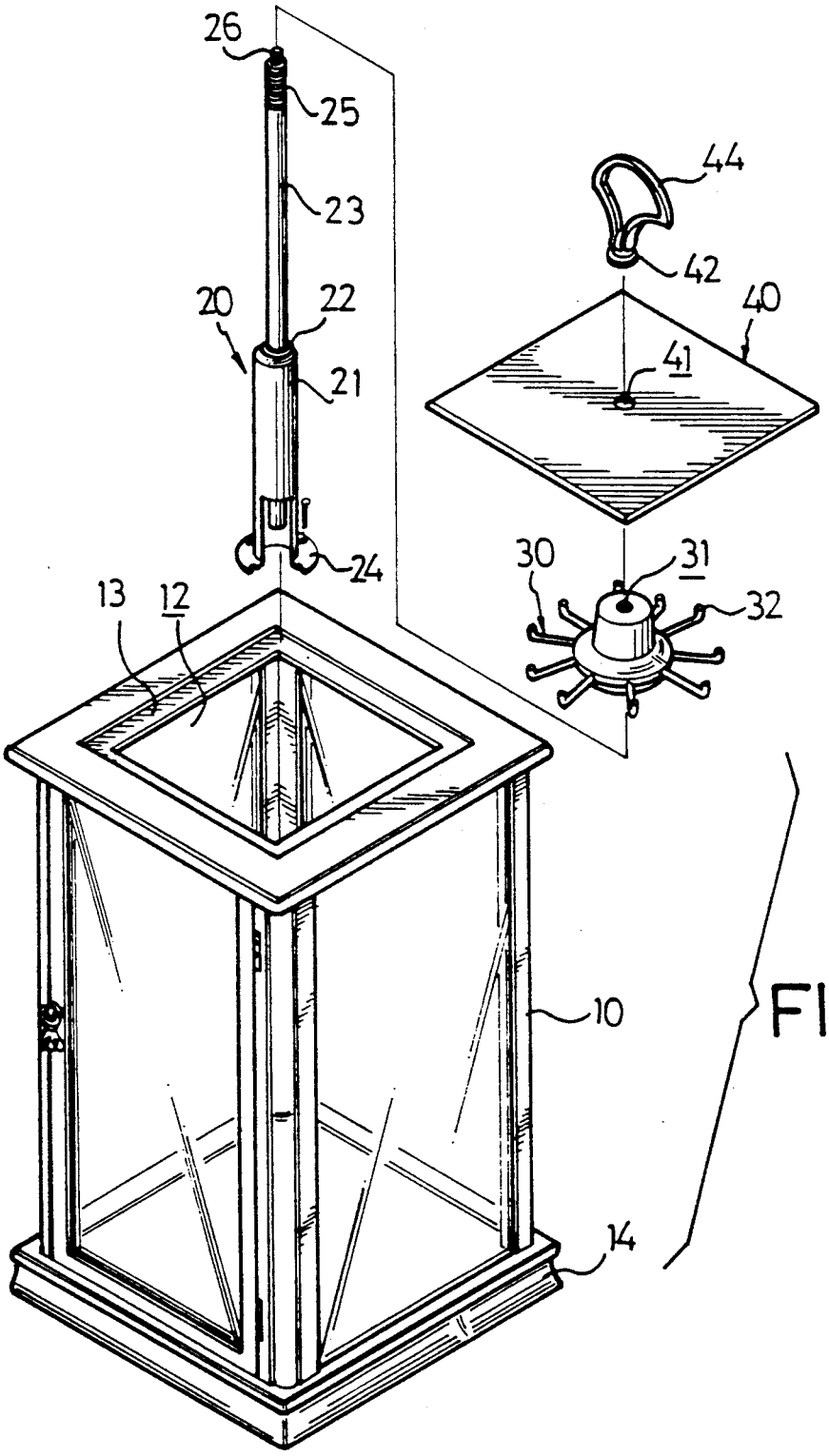
FIG. 1 is an exploded view of a jewel box in accordance with the present invention.
Figure 2:
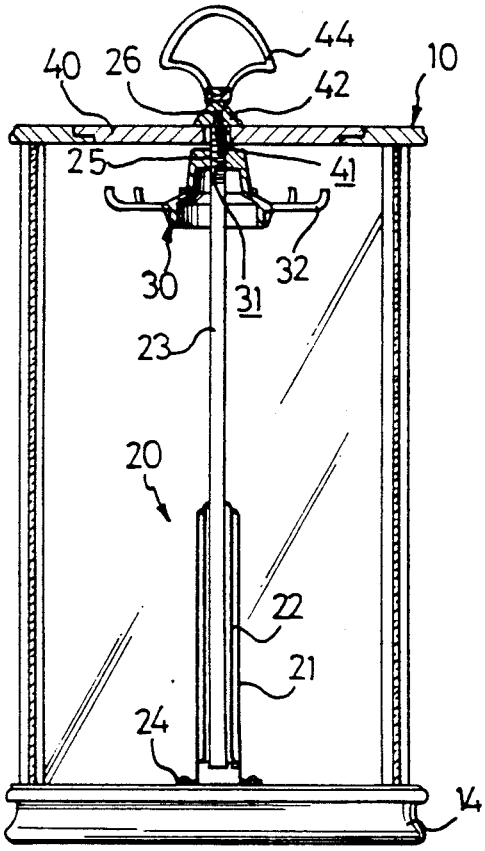
FIG. 2 is a cross sectional view of the jewel box.
Figure 3:
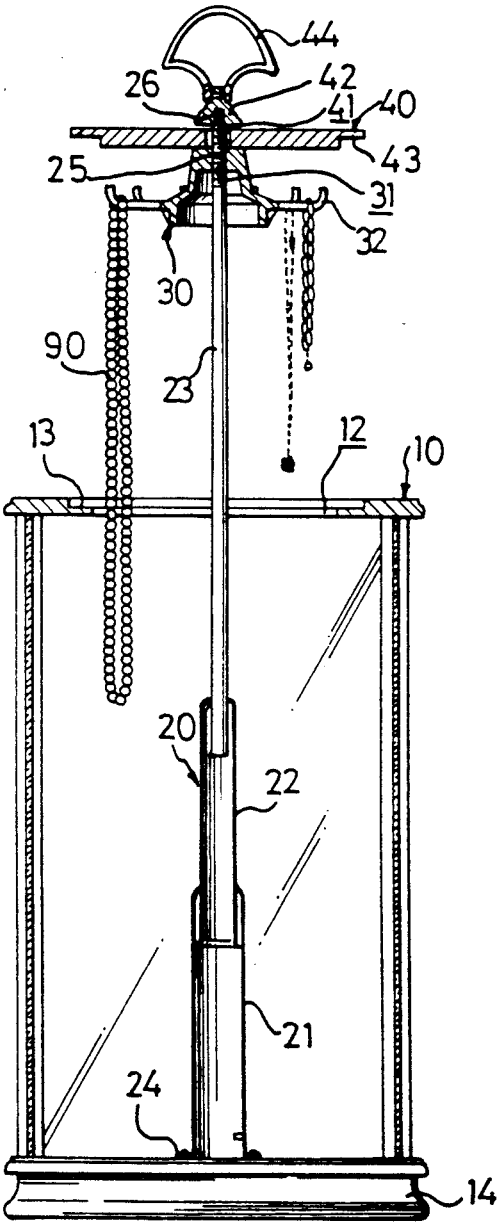
FIG. 3 is a cross sectional view similar to FIG. 2, in which the cover is lifted upward.

Referring to the drawings and initially to FIGS. 1, 2 and 3, a jewel box in accordance with the present invention comprises generally a housing 10 which is rectangular parallelepiped having four transparent sides and having a door 11. An opening 12 and a shoulder 13 formed around the opening 12 are formed in the top of the housing 10.

A telescopic tube 20 includes three sections 21, 22, 23. An annular flange 24 is integrally formed on the bottom of the lower section 21 and is fixed to the base 14 of the housing 10 by such as screws. An outer thread 25 is formed on the upper end of the upper section 23 and a stub 26 with an outer thread formed thereon is further formed on top of the upper section 23. A hanger 30 has a screw hole 31 formed in the center for threadedly engagement with the outer thread 25 of the upper section 23 and has a plurality of hooks 32 distributed around the peripheral surface thereof so that jewels 90 can be hung on the hooks 32.

A cover 40 has a hole 41 formed therein for engagement with the upper end of the upper section 23 and is fixed in place by a nut 42 so that the hanger 30, the cover 40 and the upper section 23 are fixed together. A loop member 44 is pivotally coupled to the upper portion of the nut 42 so that the hanger 30 and the cover 40 can be pulled upward. A flange 43 (FIG. 3) is formed on the perimeter of the cover 40 and can be engaged with the shoulder 13 so that the cover 40 can be retained in place. When the hanger 30 is pulled upward, the jewels 90 can be easily reached.

Figure 4:
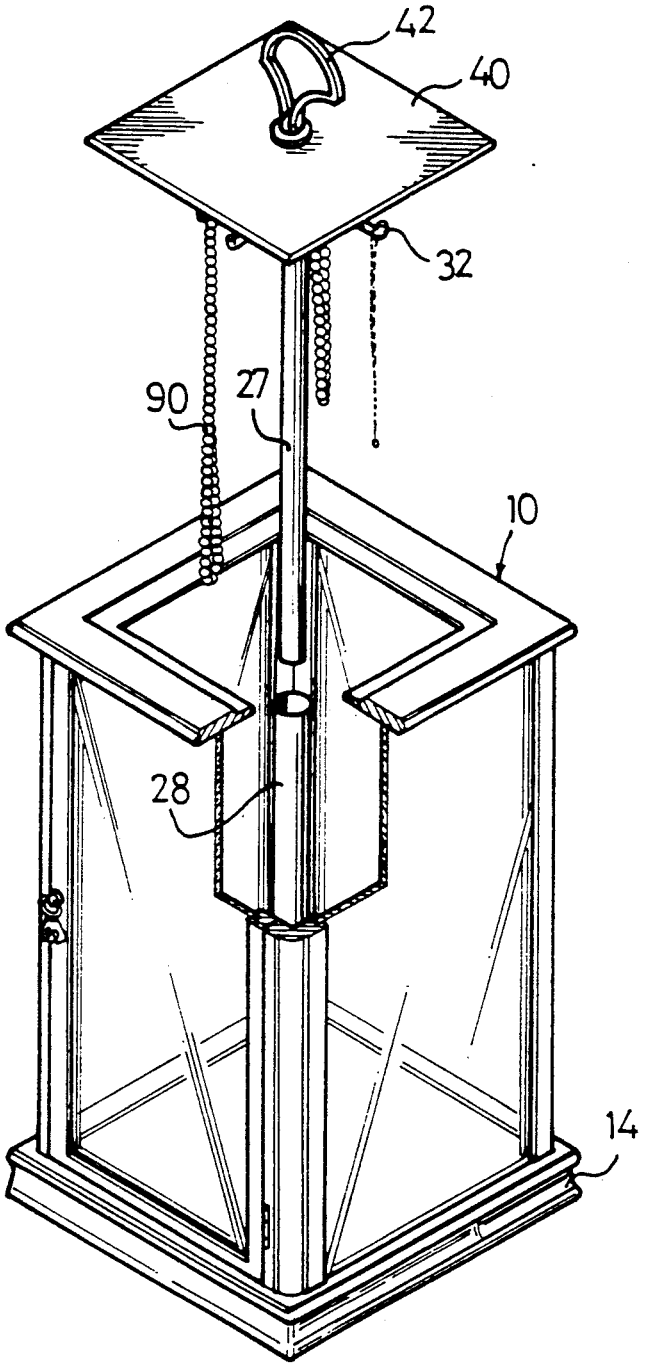
FIGS. 4 to 6 are perspective views illustrating three different embodiments of the present invention.

Referring next to FIG. 4, instead of the telescopic tube 20, a tube 28 is fixed to the base 14 of the housing 10, and a rod 27 is provided so that the rod 27 is insertable into the tube 28. The hanger 30 and the cover 40 are fixed on the upper end of the rod 27 so that the jewels 90 can also be easily reached when the hanger 30 and the rod 27 are pulled upward.

Figure 5:
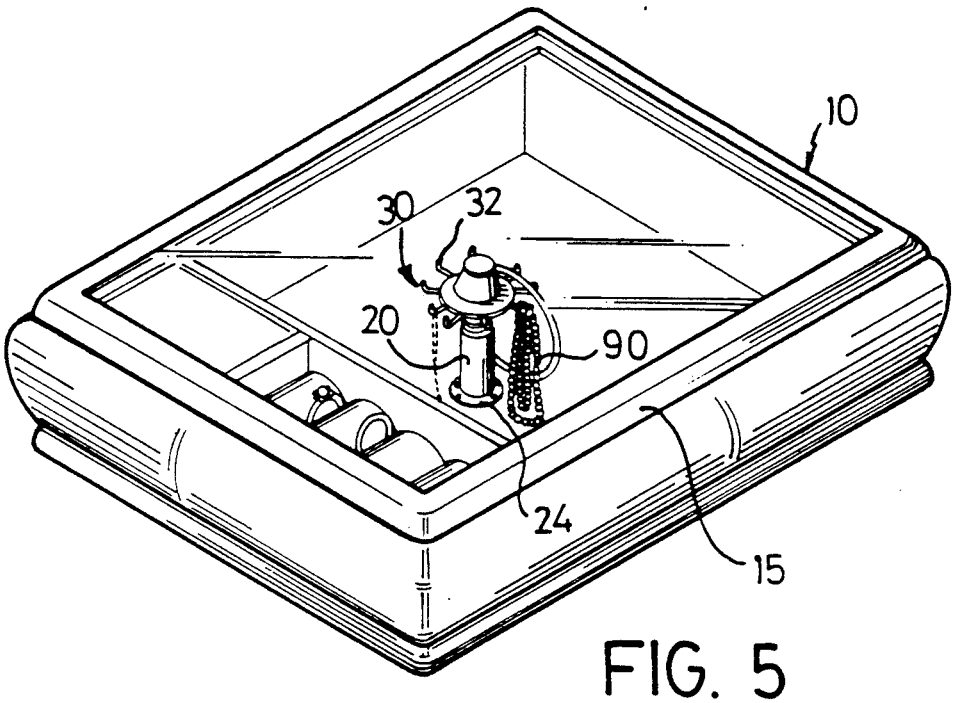

Referring next to FIG. 5, the hanger 30 is fixed directly on the upper end of the telescopic tube 20 when the housing 10 has a pivotally coupled upper door 15. The hanger 30 can be pulled upward when the door 15 is opened.

Figure 6:
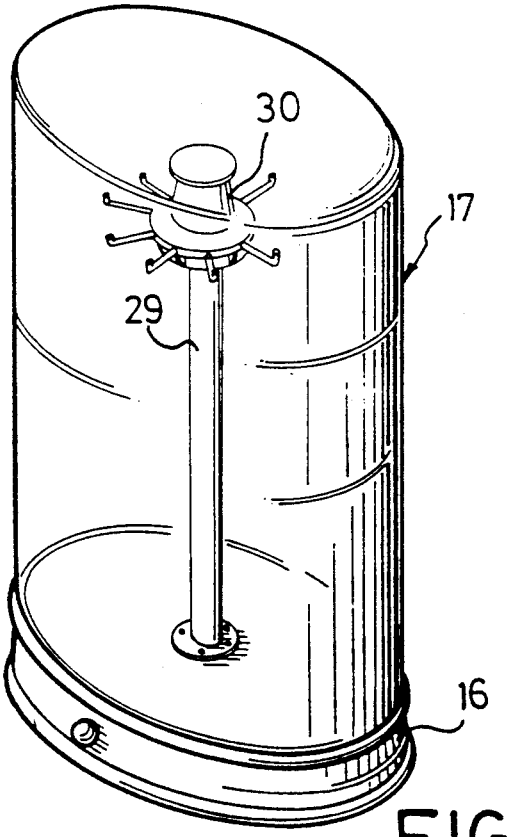

Referring next to FIG. 6, the hanger 30 is fixed directly on an upper end of a post 29 which is fixed on a base 16. A transparent casing 17 which is readily removable is disposed on the base 16 for covering the jewels hung on the hanger 30. The jewels can be easily reached when the casing 17 is removed.

Accordingly, the jewels hung on the hanger of the jewel box in accordance with the present invention can be easily reached.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A jewel box comprising a housing having a base provided on a bottom thereof, a supporting member having a lower end fixed on said base of said housing, a hanger fixed on an upper end of said supporting member, a plurality of hooks distributed around said hanger for handing jewels, an opening formed in an upper portion of said housing, said supporting member being a telescopic tube, a cover fixed on said upper end of said telescopic tube and located above said hanger and provided for enclosing said opening of said housing, and a loop member fixed on top of said telescopic tube so that said hanger may be pulled upwardly so that said jewels hung on said hooks of said hanger are easily reached.

2. A jewel box according to claim 1, wherein an outer thread is formed on said upper end of said telescopic tube, a stub with an outer thread formed on an outer surface thereof is formed on said top of said telescopic tube, a screw hole is formed in said hanger for threadedly engaged with said outer thread of said telescopic tube, a nut is engaged with said stub so that said cover can be stably retained between said nut and said hanger, and said loop member is pivotally coupled to said nut so that said hanger can be easily pulled upward.

3. A jewel box according to claim 1, wherein a shoulder is formed around said opening of said housing, a flange is formed on a perimeter of said cover and is engagable with said shoulder so that said cover can be stably retained in place.

4. A jewel box comprising a housing having a base provided on a bottom thereof, a supporting member having a lower end fixed on said base of said housing, a hanger fixed on an upper end of said supporting member, a plurality of hooks distributed around said hanger for hanging jewels, an opening formed in an upper portion of said housing, said supporting member including a tube fixed on said base of said housing, said hanger and a cover fixed on an upper end of a rod, said cover disposed about said hanger and provided for enclosing said opening of said housing, and a loop member fixed on top of said rod so that said hanger may be pulled upwardly so that said jewels hung on said hooks of said hanger are easily reached.

* * * * *